US005522334A

United States Patent [19]

Chu

[11] Patent Number: 5,522,334

[45] Date of Patent: Jun. 4, 1996

[54] FLEXIBLE PORTABLE CONTAINER FOR LEAKING TANKS

[76] Inventor: Paul E. Chu, 446 W. Hudson Ave., Englewood, N.J. 07631

[21] Appl. No.: 281,080

[22] Filed: Jul. 27, 1994

[51] Int. Cl.[6] ..... B63B 25/08

[52] U.S. Cl. ..... 114/74 R

[58] Field of Search ..... 114/74 R, 74 T, 114/74 A, 256, 257, 227, 228, 229; 220/403, 900

[56] References Cited

U.S. PATENT DOCUMENTS

| | | | |
|---|---|---|---|
| 2,994,452 | 8/1961 | Morrison | 114/74 R |
| 3,707,937 | 1/1973 | Liles | 114/74 R |
| 4,573,426 | 3/1986 | Larsson . | |
| 5,051,029 | 9/1991 | Ecker | 405/68 |
| 5,052,319 | 10/1991 | Beyrouty | 114/74 T |
| 5,072,623 | 12/1991 | Hendershot | 73/49.2 |
| 5,139,363 | 8/1992 | Jenkins | 405/63 |

*Primary Examiner*—Jesus D. Sotelo

[57] ABSTRACT

The invention is a flexible portable container for leaking oil tanks which is designed to stop oil spills at their source by preventing the oil from entering the water. The invention in its preferred construction consists of flexible plastic sheets heat-sealed into a shape and size somewhat larger than the oil tank in which it will be used, except for very large tanks, in which multiple units of the invention are used. The top opening is provided with radiating expansion tubes attached to the perimeter of the opening with side arms reaching the adjoining tube. These tubes are inflated by the compressed gas or air compressor to which they are connected. They force the perimeter of said opening against the walls at the bottom of said tank. Built-in flotation tubes around said opening are then inflated to raise said opening to the surface of the liquid, thereby enclosing, except for said top, the remaining contents of said tank. The remaining oil is thereby prevented from entering the water to cause catastrophic damage. The operator pulls the draw-cord while deflating all the tubes to close the top, twists it and ties it to secure the contents even if the ship capsizes. The metal tank, even in its damaged condition, serves as a base and reinforcement for the flexible portable container. A simpler version of the flexible portable container having a draw-cord at the top and a tube directly below into which many magnets are inserted, is used on the outside of the gash. The magnets are arranged around said gash with the help of suitably equipped extensible poles to move said magnets around to surround said gash.

11 Claims, 4 Drawing Sheets

FLEXIBLE PORTABLE CONTAINER FOR LEAKING TANKS

BACKGROUND

1. Field of Invention

Oil spill disasters have occurred worldwide, with lesser spills taking place almost daily in the waterways of the world. My invention's primary aim is to reduce the amount of fluids entering the water in the first place, rather than in trying to mop up the oil after it has entered the water.

2. Discussion of Prior Art

Tanks containing liquids are used everywhere: on the sea on tankers, barges, ships; on land on rail, tank trucks, in fixed positions. A large percentage of these have no means of stopping any leakage of the fluids when the tank is punctured.

Oil leaks such as that of the Exxon Valdez foul untold miles of shoreline, kill marine life, birds, wild fowl, and prevent man from enjoying the natural beauty and bounties of the affected area.

Once oil starts to leak, no means of stopping the leak has been available so millions of barrels of oil spread far and wide. All the known means of containment and cleanup must have been used, and yet, after those huge efforts, men were shown wiping sticky stuff from stone by stone. It therefore appears obvious that every barrel of oil that is kept from entering the water benefits mankind.

Most of the present art consists of using floating booms to restrict the spread of oil and means to collect and absorb the oil. Storms can and do frustrate man's feeble attempts at containment.

U.S. Pat. No. 4,573,426 covers a boom resting on the sea bed and is activated to float to the surface when the need arises. Its usefulness is limited to the tiny spot where it has been installed. How effectively it can handle any spill depends on the weather conditions prevailing at the time of the spill.

U.S. Pat. No. 5,051,029 shows a flexible buoyant boom and containment stored in a housing built all around a tanker-ship or offshore derrick. The boom can be activated in a short time. This expensive equipment can only serve the ships and derricks around which it has been built.

U.S. Pat. No. 5,139,363 covers an inflatable boom with a plurality of storage tanks to recover the spilt oil. The last two words "spilt oil" are what my invention is designed to reduce. The inflatable boom and all the many parts needed by this patent cited may not be assembled soon enough for distant spills, so its use may be limited.

U.S. Pat. No. 5,072,623 shows a double bladder fluid containment system built into a tank, with means to monitor leakage. It is effective only on the tanker so outfitted.

OBJECTS AND ADVANTAGES OF THE INVENTION

The chief object of my invention is to reduce the amount of the contents of leaking tanks that flows out into the water or surrounding areas by speedily lowering my flexible portable container, which is folded compactly into a small bundle, into the tank. A slight tension on the lowering means keeps said container upright as it sinks to the bottom. Its opening is spanned by expansion tubes 12 which radiate to the perimeter and are attached to it, as are their sidearms 13. At the bottom of the tank, the expansion tubes are inflated by using a cylinder of compressed gas, or by other means such as a compressor on the deck connected by air hose. This forces said opening to spread open against the walls surrounding the bottom of the tank.

The gas is then directed by a pressure regulator valve into the flotation tubes 18 which are built around said opening, directly below the top. The inflated flotation tubes rise in the liquid. When the top of said opening reaches the surface, most of the fluid remaining in said tank will be in the flexible portable container, thereby stopping its further leakage. At this point, the operator pulls on the draw-cord 22 as she, at the same time, deflates the expansion tubes and the flotation tubes. She then gathers said top, twists it and ties it to secure the contents for its later transfer.

At the same time, on the outside of the tank, another worker can use a simpler version of the Flexible Portable Container equipped with magnets installed into a tube around said container's opening. The magnets are arranged around the gash aided by means such as extensible poles or a diver if necessary, thereby holding said container's opening against the tanker and catching the outflow from said gash before it hits the water. The body of said container trailing in the water catches the outflow before it contaminates the water.

Both the above procedures can be completed in a matter of minutes. For extremely long gashes, several magnetized units can be placed simultaneously by others of the crew.

In case of danger as when a tanker is battered in a storm near rocky shores, the Flexible Portable Containers can be activated within the ship before any damage is done to said ship and the contents of the tank is secured within the invention. If said ship is subsequently gashed, the gashed metal would merely push the yielding material of said Flexible Portable Container against the yielding liquid within it and not cause any tear.

If tankers are not supplied with the invention, its light weight and compactness make it possible to fly in any number of units quickly. Or they can be dropped by helicopters onto the decks of distressed tankers and barges. On isolated land areas, even motorcycles equipped with sidecars can be used to deliver units to tankers needing them.

The Flexible Portable Container is designed to be lowered into the tank of liquid in a folded, compact unit including a cylinder of compressed gas for expanding said container's opening against the walls at the bottom of the tank. Said opening is then floated to the surface of the liquid by inflating the flotation tubes built around said opening, thereby enclosing the liquid within said flexible portable container. The draw-cord is then pulled at the same time that the flotation and expansion tubes are deflated. The top is gathered together, twisted and tied to secure the contents of said tank to prevent its leakage even if the ship rolls over. Said tank, even in its damaged condition provides the unit's strength and shape.

By installing the Flexible Portable Container in the tank before a gash occurs, most of the contents of said tank is already within said flexible portable container. If said tank is subsequently punctured, the puncture would merely push the flexible material inward as it is loose-fitting with only the yielding liquid behind it. The contents of said tank therefore remain within said flexible container which is reinforced by the metallic tank even in its damaged shape.

At the same time that the unit is used inside the tank, a simpler version of the Flexible Portable Container with the circumference of its opening outfitted with magnets set into one of the flotation tubes, can have said magnets arranged around the gash, thereby surrounding it and holding said container against the metal tank, while the body of said container floats in the water, catching the outflow and preventing its spreading. When filled, its opening can be tied and secured while another unit replaces it. Or its trailing end can be tied into collector-tankers or barges.

The use of the Flexible Portable Container in the tank and the simultaneous deployment of the simpler unit on the outside of said tank would result in the largest amount of contaminants saved.

The need to provide a portable, flexible means of preventing or minimizing the outflow of contaminating liquids will become more and more important as all nations are developing increasing demands for oil for their developing industries and also for the worldwide desire for motorcars and motorbikes and the ability to purchase them by those who now use bicycles or ride camels.

The advantages of the Flexible Portable Containers over other systems include the following:

1. The units are portable. They are not fixed to an isolated spot on earth, nor to a single tank or derrick, or to a single vessel. They can be carried on board tankers for instant use. For large tanks, a number of units of the Flexible Portable Containers can be used simultaneously, or as needed. For tankers not supplied, the compactness and light weight of said containers make it possible to transport them easily by plane, helicopters, speedboats and land vehicles anywhere they are needed. They can also be stored in many parts of the world for emergency use.

2. Built-in equipment serve only the limited number of units already built in. All the other tanks in the world do not benefit from them. For these other tanks, if they leak, the built-in equipment may as well be nonexistent.

3. Seabed flotation units are limited to the single spot in which they are installed. They look much more expensive than this invention. Besides, they do not prevent the oil from entering the water in the first place.

4. The numerous flotation booms are used to restrict the spread of oil only after the oil has already leaked and contaminated the water. The mop-up methods and materials used are all employed to reduce the damage which has already taken place. The Flexible Portable Containers are intended to reduce the amount of contaminants from entering the water or overflowing land. We believe that this is a preeminent example of the adage "an ounce of prevention is better than a pound of cure." The Flexible Portable Container, by reducing the amount of oil entering the water, will greatly decrease the amount of tedious, rugged, undesirable and costly tasks related to oil clean-ups. It also reduces the ecological damage resulting from oil spills: dead fish, dead birds, dead marine plants, fouled beaches, damaged shores, destroyed livelihood for man.

Staggering costs have been incurred from oil spills and I believe that even such huge, devastating, extensive damage as the Exxon Valdez disaster could have been enormously reduced had the Flexible Portable Containers been available and used.

Further objects and advantages of my invention will become apparent from a consideration of the drawings and ensuing description of it.

DESCRIPTION OF DRAWINGS

FIGS. 1 and 2 show said opening of said invention after rising from the bottom of the metal tank 20 due to the inflation of the flotation tubes 18 which are built around the perimeter of said opening and become an integral part of said container. The fully open top rising from the bottom to the surface of the liquid, encloses the contents of said tank thereby containing said contents and preventing its leakage.

LIST OF REFERENCE NUMERALS

Figure 1:
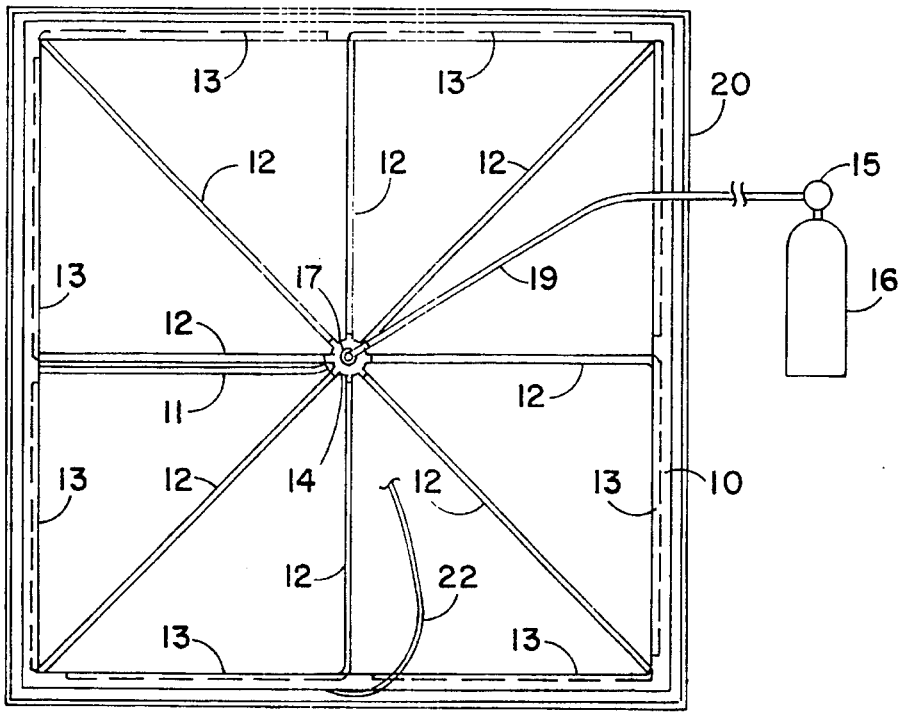
FIG. 1 is a top plan view of my invention, the Flexible Portable Container 10, with its opening pushed fully open by the expansion tubes 12 and their sidearms 13 which are heat-sealed into and become a part of said opening.

10 Flexible Portable Container for Leaking Tanks.

11 Pressure controlled air tube leading from distributor 14 to top flotation tube 18*a*.

12 Radiating inflatable expansion tubes at top opening of 10.

13 Side arms of 12, attached to 10.

14 Distributor to which the expansion tubes 12 are connected, and also the flotation tube 18*a*.

15 Valves or timer to control the flow of gas, both to the expansion tubes 12, and the flotation tube 18*a*.

16 Compressed gas container or other gas source.

17 Pressure regulator valve.

18*a*

18*b*

18*c* Built-in flotation tubes, as many as required, around the

18*d* perimeter of 10 for floating the open end of 10 to the surface.

18*e*

18*f*

19 Air hose from compressed air source to 17 and 14.

20 Metal tank.

21 Tube for draw-cord 22.

22 Draw-cord to close 10, and also to lower the invention to the bottom of the tank, and to keep said invention upright.

24 Tube for magnets.

25 Magnets

26 Initial position of 10 before lowered to bottom of tank.

29 Top of fluid.

30 Top of tank 20.

31 Gash on outside of tank 20 (and ship).

35 Means connecting bottom of invention to collector-tanks/barges.

DESCRIPTION OF INVENTION

FIG. 1 shows a top plan view of the flexible portable container 10 in its fully open condition within the metal tank 20. Radiating inflatable expansion tubes 12, extend from a central point consisting of a distributor 14, to which each expansion tube is connected. The portion of 12 that reaches the opposite side of said container's opening is attached to said container and also sideways 13 to reach close to the adjoining tube 12. If plastic materials are used, heat-sealing can be used to accomplish the attaching. These radiating tubes and arms extend over nearly the entire perimeter of said container's opening.

The inlet of 14 is connected by an air hose to a source of inflating gas, or compressed air or a compressor on the deck. If the source is compressed air, a pressure regulator valve 17, can be set for the inflation to begin after the flexible portable container has been lowered to the bottom of the tank. Or when ready to be used, the gas source can be opened to a pressure-activated valve set to open at the pressure of the bottom of the tank. If the inflating source is a tank of compressed air or carbon dioxide kept on the deck, the distributor can be connected with the required length of air hose to reach the bottom. Then the operator can turn the inflating gas on when said container reaches the bottom of the tank. The inlet valve 15, is also used to release the gas to deflate the expansion tubes 12, as well as the flotation tubes 18 after the perimeter of the opening of said container has floated to the surface of the liquid. Draw-cord 22 encircles the opening near the top of said container in a built-in tube 21.

Figure 2:
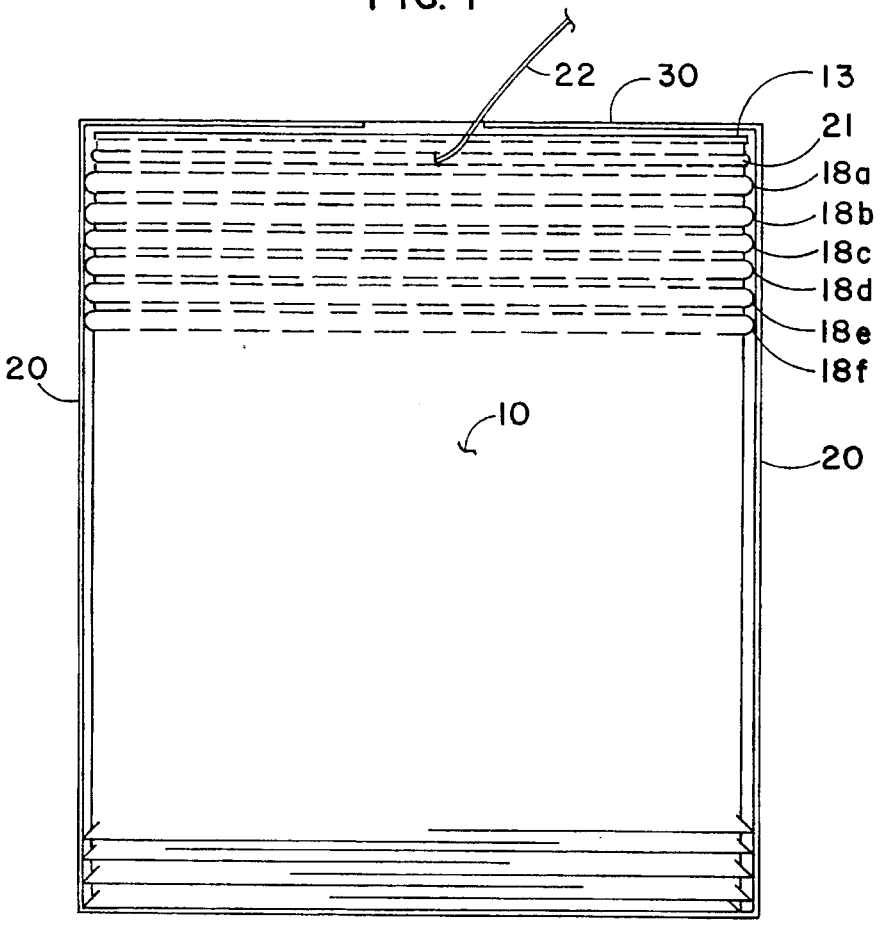
Figure 3:
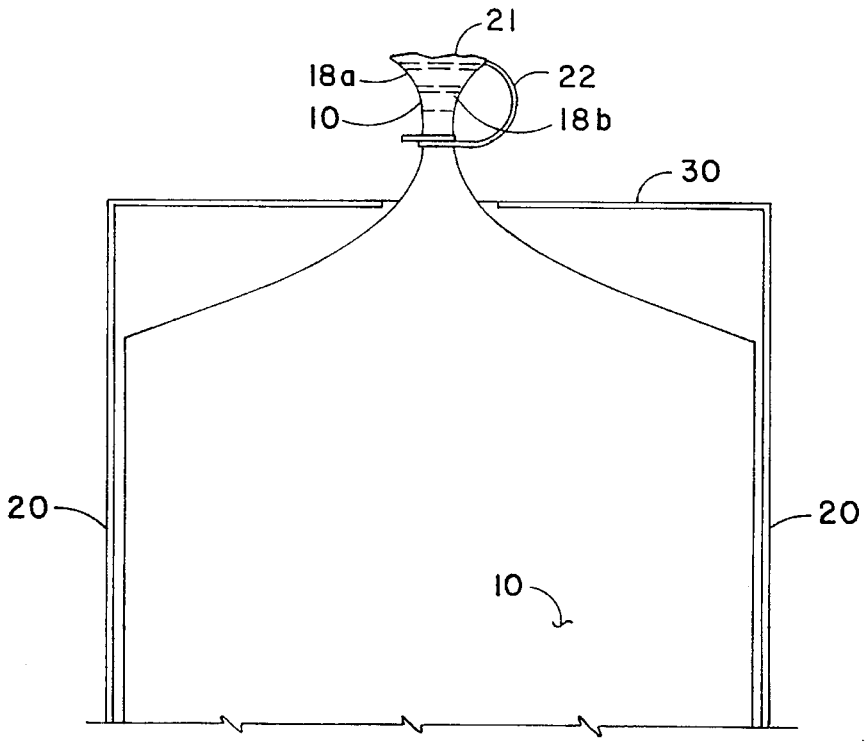
FIG. 3 shows a sectional view of the invention filled, and with the top gathered together and tied securely, and resting within the metal tank which supports and reinforces it.
Figure 4:
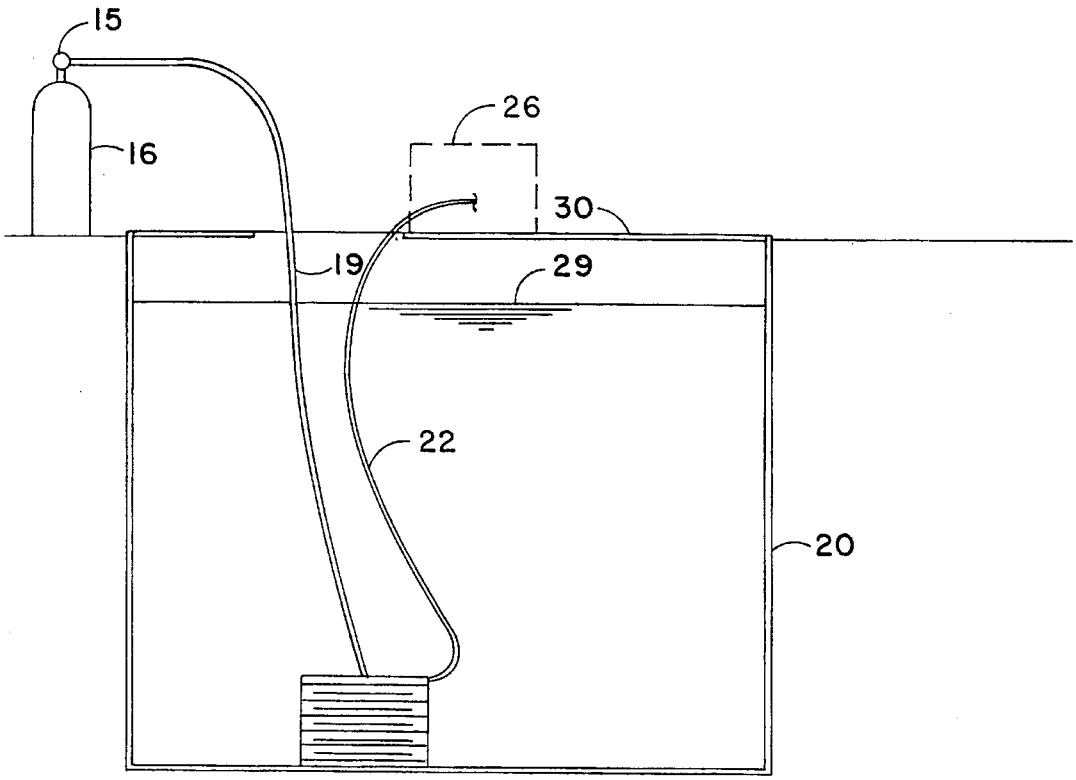
FIG. 4 is a sectional view that shows the compactly folded invention lowered to the bottom of the tank from its storage spot indicated by number 26, on the top of said tank near a "container-hole".
Figure 5:
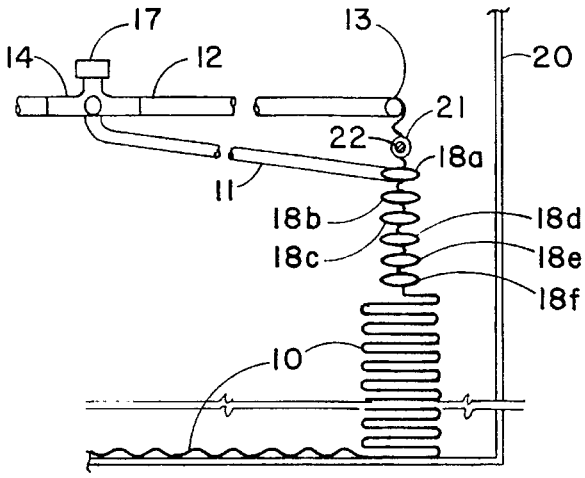
FIG. 5 is an enlarged sectional view of the accordion-folds of the flexible portable container at the bottom of the tank before the flotation tubes 18 are inflated to raise the sides of said container toward the surface.
Figure 6:
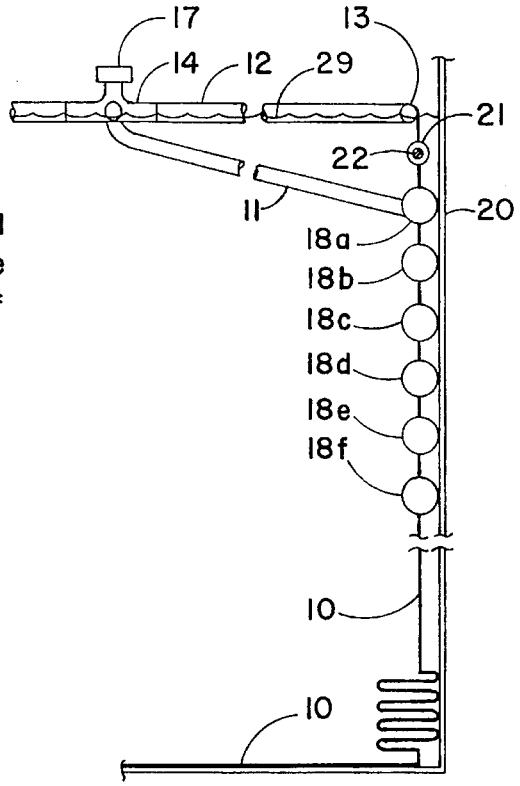
FIG. 6 is a sectional side view showing the flotation tubes 18 inflated and having raised the top of the flexible container 10 indicated by 12 and 13, the expansion tubes, to the surface of the liquid 29. At this point, the operator can use draw-cord 22 to close the top and secure the contents.
Figure 7:
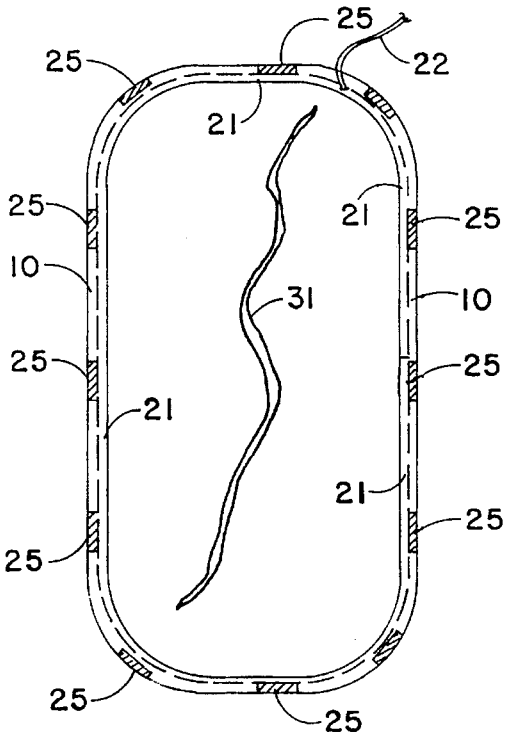
FIG. 7 is a plan view of a simpler version of the invention with magnets 25 set in a tube around said invention's opening. Said magnets are arranged around the gash 31 in the metal tank (and ship), using extensible rods preferably, or divers if necessary, to move said magnets into place. This version of the invention is used on the outside of the tank to catch the liquid that is leaking out. Instead of escaping into the sea, the leaking oil flows into the container floating in the water.
Figure 8:
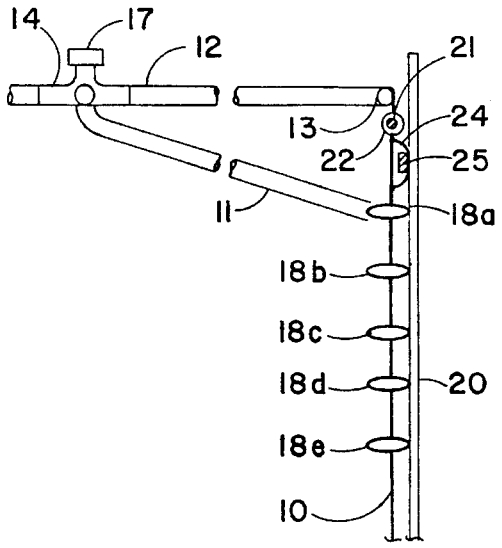
FIG. 8 shows one way to add a tube for inserting magnets in a regular flexible portable container. Slits can be made in the tube to insert the magnets, and the slits resealed by using special adhesive tape. It is preferable to reduce the number of expansion tubes 12 and flotation tubes 18 to a minimum when using magnets.
Figure 9:
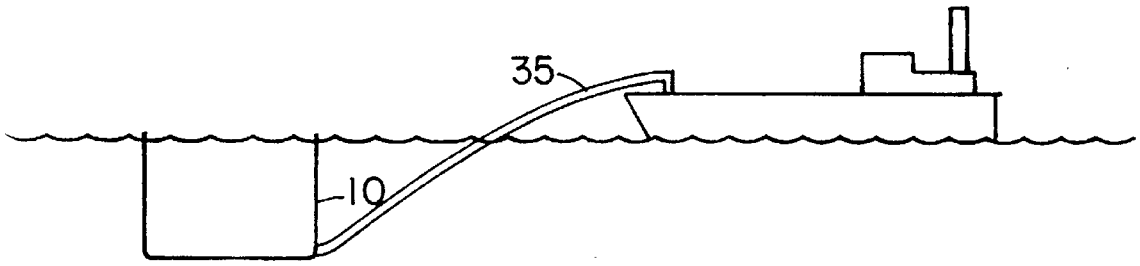
FIG. 9 is a perspective view of means 35 attached to the bottom of container to tie to storage tanks/barges.

FIG. 2 is a typical plan side view of the invention. Flotation tubes 18*a*, 18*b*, 18*c*, and as many more as are needed, are built completely around the perimeter near the top of the opening by heat-sealing to 10 a plastic sheet placed around the opening. Any two parallel seals will form a tube. Tube 18*a* is connected to distributor 14 by air tube 11 shown in FIGS. 5 and 6, and is set to inflate by valve 17 after the radiating expansion tubes 12, have been inflated, and the perimeter of said container has reached the sides of the bottom of the metal tank. Tube 18*b* is connected to the end of 18*a*, and 18*c* is connected to the end of 18*b*, etc.

Thus it is seen that the tank of compressed air 16, is connected to valve 15, which is connected to air hose 19, which is connected to distributor 14, which is connected to all the radiating inflatable expansion tubes 12 and their sidearms 13, which are attached to the perimeter of the opening of said container. Distributor 14 is also connected with flotation tube 18*a* by means of a pressure regulated valve 17 which leads to air tube 11. Valve 17 opens after the tubes 12 have been inflated and expanded said opening to the walls so that when the flotation tubes 18 rise, they will surround the contents of said tank. Tubes 18*a*, 18*b*, 18*c*, etc. are connected in series so that the rising of the Flexible Portable Container takes place at almost the same rate on all walls of the metal tank, rather than all at one end first and slowly along the other sides of the tank.

The sides of the Flexible Portable Container as well as the bottom are preferably made of continuous flexible plastic sheets, which generally come in rolls in various thicknesses, widths and lengths. The selected material is joined together by heat-sealing or other sealing methods commercially available to form containers to fit various size tanks in oil tankers, barges, ships, tanks on trucks, railcars, stationary tanks on land, etc. For the average tank, the length and width of the container should be somewhat larger than those of the tank in which said container will be used in order to take care of deformations in the tank. The height, however, should be considerably greater than the depth of said tank in order to allow for the top surface as well as for raising and gathering the top together to close and secure the opening. After the sides and bottom have been completed, additional widths of the material are placed around the perimeter of the opening to be sealed to form tubes for the draw-cord 22, and also for the flotation tubes 18*a*, 18*b*, 18*c*, etc. The top tube can have the draw-cord inserted after one seal has been made, before the second seal completes the tube, but leaving room for the ends of the cord to reach the deck. The expansion tubes 12 are preferably made of selected diameter flexible plastic tubes readily available commercially. One end is sealed to distributor 14, and the other end stretched to the opposite side of the opening where it is attached, together with a sidearm 13, to reach near the point where the adjoining expansion tube 12 will be attached. The entire length of the sidearms 13 as well as the ends are sealed to the perimeter. The expansion tubes and their sidearms should nearly cover the entire perimeter of the opening.

Valve 15 is connected to the distributor 14 by air hose 19 and to the gas source 16. The free end of the draw-cord should be long enough to allow the operator to lower the compactly folded flexible portable container into the tank with a slight tension, when it is used, in order to keep said container upright.

The completed flexible portable container is carefully folded accordion-style into a compact pack, keeping the opening at the top, together with the compressed gas container. The entire unit is protected with a suitable cover which can be easily slipped off. Such a unit can be stored on the top near an opening in the tank in which it may be used.

OPERATION OF INVENTION

When needed, the protective cover is removed, and the unit is lowered into the tank through the "container-hole" on the top of the tank by means of the ends of the draw-cord 22. The pressure regulated valve turns the gas on when the unit reaches the bottom of the tank. The expansion tubes 12 and the sidearms 13 inflate, pushing the perimeter of the opening outwards toward the walls at the bottom of the tank.

The pressure regulator valve 17 then directs the gas to flotation tubes 18*a*, 18*b* and 18*c*, etc. causing the perimeter of the opening of the invention to rise to the surface. If the flexible portable container fits the tank, most of the remaining contents of the tank will be inside said container, thereby stopping further leakage. If the tank is extra large, additional units of the invention must be installed into the tank to fill up the volume of said tank.

When the perimeter of the opening reaches the surface, the operator pulls on the ends of the draw-cord 22 while she at the same time turns the valves to deflate both the expansion and flotation tubes. She gathers the top together, twists it to close it, and then ties the top together so as to secure the contents within the invention.

Said contents should be transferred to tankers when conditions permit.

Simpler forms of the Flexible Portable Container can have fewer tubes around the perimeter of the opening. One tube is to hold the draw-cord 22, and another to hold magnets to attach the opening of said container to the outside of the metal tank to surround the gash in said tank so that the leaking oil flows into said Flexible Portable Container rather than foul the sea. Workers using long extensible poles whose ends are fitted with padded "hands" can quickly move the magnets to surround said gash. If necessary, divers can help in the process. The outflowing oil will be caught by said flexible portable container floating in the water. The bottom of said container can be tied in directly to storage tankers. The draw-cord 22 is used to tie and seal said container when it is filled while other units are deployed. Mechanical arms and padded wood or metal frames can be used to hold said container more securely to the ship.

The regular unit inside the tank and the magnetized unit on the outside will save the largest amount of the contents of the tank.

The Flexible Portable Container, with its opening inflated, can also be held open-side facing down and partly submerged, directly over a gushing oil flow from a sunken leak or even from a leaking undersea well, and catch a lot of the oil in its trailing "bag" which can be attached to storage tankers, barges or temporary storage means.

Thus it is seen that there are several ways to use the invention, each of which reduces the amount of leaking oil from damaging human, animal, plant and mineral kingdoms.

CONCLUSION, RAMIFICATIONS AND SCOPE OF INVENTION

Thus the reader will see that the flexible portable container for leaking tanks provides a highly portable, valuable means in man's arsenal to protect his environment from the scourge of devastating oil spills and to keep his world livable. The invention makes it possible to reduce the amount of oil that enters the water and to control oil spills as soon as they start because the required units can be carried on board tankers for immediate use and it takes only one person to activate it. Other systems attack the problem after the oil has entered the water, except for built-in units of various kinds which can work only on the units so equipped. For all the other tanks in the world, these built-in units would be of no use whatsoever. After oil enters the water, damage is already done. Weather can hamper clean-up efforts and weather can carry spilt oil far and wide.

Therefore, this invention, by keeping the oil out of the water in the first place, should become the premier method for safeguarding man from oil spills.

The materials used in its construction are the lightest possible to give protection to the largest volume. The factor of portability is especially important, because most of the tankers and ships in the world are not provided with internally-built safety equipment such as double hulls and their equivalent.

The three major uses of the invention: the magnetized units outside the gash that immediately catches the spilling oil, the internal units to contain the oil within the invention, and the open units held over bubbling undersea leaks account for a sizable portion of oil leakage in the waterways of the world.

An additional way to use the invention is to stretch its opening over a pair of U-shaped frames held with the open ends facing each other, partly submerged in front of a boat heading into an oil leak. The body of the invention floating in the water should catch much of the floating oil.

While the above description contains many specifics on the construction, they should not be construed as limitations on the scope of the invention, but rather as an exemplification of one embodiment thereof. Many other variations are possible. For example, the material used for the body of the invention can be sheets of material sprayed with compositions inert to the contents of the tanks. Or bubble-type plastic can be substituted for certain areas of the invention. The expansion tubes 12 can be replaced with sets of extensible rods activated by spring or compressed air. The flotation tubes 18*a*, 18*b* and 18*c* can be replaced by floats released to the surface and which can be connected to a cord which the operator can pull up to raise the perimeter of the invention to the surface.

I claim:

1. A flexible portable container introducible into leaking tanks to enclose the contents of said leaking tanks and prevent further leaking, comprising:

(a) a flexible portable body foldable compactly, (b) an openable top around the perimeter of which tubes are secured, leading to a central air distributor connected to a compressed air source, each of said tubes having said air source is turned on by the operator when the compactly folded portable body has been lowered to the bottom of said leaking tank, to force the tubes and said perimeter to extend toward the walls at the bottom of said tank, (d) flotation tubes built around said perimeter, said tubes being connected to said compressed air source to inflate said flotation tubes to float said open perimeter to the surface, thereby surrounding the remaining liquid in said tank and preventing further leakage.

2. The portable container of claim 1 wherein means are built into the top of said container to secure the contents, comprising:

(a) a tube around said perimeter of said top, (b) a cord built into said tube, the ends of said cord extends beyond said tube so as to be used by an operator to close and tie the opening of said container to secure its contents.

3. A flexible portable container having an opening surrounded by magnets to hold said opening to surround the outside of any leaks in leaking tanks to which said magnets can attach so that the leaking fluid will flow into said container, comprising:

(a) a flexible portable body foldable compactly, (b) an openable top around the perimeter of which a tube is built, (c) said magnets being inserted into said tube, and said tube being arranged to surround said leaks.

4. The flexible portable container of claim 3 wherein means are added to secure said container's contents, comprising:

(a) a second tube built around the perimeter of said openable top, (b) a cord being built into said tube, the ends of said cord extending beyond said tube so as to be used by an operator to close and tie said opening to safeguard the liquid caught in said container.

5. The flexible portable container of claim 3 wherein means are added to the bottom of said container to give it great capacity, comprising:

(a) connectors at bottom of said container, joining (b) tubes or hoses leading to collector-tanks, barges or tankers.

6. The flexible portable container of claim 5 wherein means are added to said container's opening to close and tie it to secure said container's contents, comprising:

(a) a second tube built around the perimeter of said container's opening, (b) a cord built into said tube, the ends of said cord meet and extend beyond said tube so as to be used by an operator to close and tie said opening to safeguard the contents of said container.

7. A flexible portable container designed to recover oil rising to the surface of water from underwater leaks or underwater wells, comprising:

(a) a flexible portable body, (b) an openable top, (c) a series of tubes built around the perimeter of the opening, said tubes being connected to a source of compressed air and are being inflated when in use, (d) U-shaped frames over which the uppermost half of the inflated tubes of the open top of the container is stretched, said frames are held facing the rising oil from boats, with the two arms of the U in a horizontal position and the single arm in a vertical position, the lower of the two arms held just below the surface of the water and the floating oil, with the first half of the inflated tubes submerged while the remaining inflated tubes float on the surface to form humps over which the rising oil must flow in order to reach the body of the container floating on the water, said humps serve to keep the oil within said container.

8. The flexible portable container of claim 7 wherein means are built into the top of said container in order to close and tie said opening to safeguard the contents, comprising:

(a) a tube built around the perimeter of said top, (b) a cord built into said tube, the ends of said cord extend beyond said tube so as to be used by an operator to close and tie said opening to secure its contents.

9. The flexible portable container of claim 7 wherein means are added to the bottom of said container to increase its capacity, comprising:

(a) connectors at bottom of said container, connecting to (b) hoses or tubes leading to collector-tanks, barges, or tankers and their pumps.

10. A flexible portable container introducible into leaking tanks to enclose the contents of said tanks and prevent further leaking, comprising:

(a) a flexible portable body foldable compactly, (b) an openable top attached around the perimeter to stretchable expandable means which are connected to a source of compressed gas or air to force open said top and keep it open, (c) flotation tubes built into the perimeter of said opening of said container and connected to said compressed gas source, to raise said open top to the surface, whereby the liquid is surrounded by said flexible container, thereby preventing further leakage of the liquid within said container and said leaking tank.

11. The flexible portable container of claim 10, wherein means are added to secure the contents, comprising:

(a) a tube built around the perimeter of said opening, (b) a cord built into said tube, the ends of said cord meet and extend beyond said tube so as to be used to close and tie said opening to safeguard the contents of said container.

* * * * *